US007743725B2

(12) United States Patent
Kengerski

(10) Patent No.: US 7,743,725 B2
(45) Date of Patent: Jun. 29, 2010

(54) HELMET BRACKET

(76) Inventor: Michael J. Kengerski, 1225 Merkle, Ortonville, MI (US) 48462

( * ) Notice: Subject to any disclaimer, the term of this patent is extended or adjusted under 35 U.S.C. 154(b) by 539 days.

(21) Appl. No.: 11/589,567

(22) Filed: Oct. 30, 2006

(65) Prior Publication Data

US 2007/0101922 A1 May 10, 2007

Related U.S. Application Data

(60) Provisional application No. 60/731,314, filed on Oct. 28, 2005.

(51) Int. Cl.
*G09F 17/00* (2006.01)

(52) U.S. Cl. ..... 116/173; 116/28 R; 2/422; 2/209.13

(58) Field of Classification Search ..... 116/173–175, 116/28 R, 209; 2/209.13, 171, 244, 422, 2/DIG. 11, 410, 425; 40/329, 586, 607.13, 40/709, 765; 132/275; D2/865, 869, 891, D2/895

See application file for complete search history.

(56) References Cited

U.S. PATENT DOCUMENTS

| | | | | | |
|---|---|---|---|---|---|
| 3,104,644 | A * | 9/1963 | Burton | 116/209 |
| 3,119,370 | A * | 1/1964 | Keats | 116/173 |
| 3,213,823 | A * | 10/1965 | Levy et al. | 116/203 |
| D208,351 | S * | 8/1967 | Harmer | D29/122 |
| 3,599,599 | A * | 8/1971 | Jones | 116/173 |
| 4,800,834 | A * | 1/1989 | Feng | 116/173 |
| 4,805,834 | A * | 2/1989 | Saba | 232/34 |
| 4,920,910 | A * | 5/1990 | Lin | 116/173 |
| 5,067,269 | A * | 11/1991 | Eppley et al. | 43/17 |
| 5,363,792 | A * | 11/1994 | Petechik | 116/28 R |
| 6,049,912 | A * | 4/2000 | Linehan | 2/209.13 |
| D440,184 | S * | 4/2001 | Jones et al. | D11/166 |
| 6,718,559 | B1 * | 4/2004 | Davidson | 2/422 |
| 6,964,403 | B2 * | 11/2005 | Fox | 248/537 |
| 7,114,198 | B1 * | 10/2006 | Hsieh et al. | 2/422 |
| 7,234,411 | B1 * | 6/2007 | Butler | 116/173 |
| 2006/0021117 | A1 * | 2/2006 | Madonia | 2/422 |

* cited by examiner

*Primary Examiner*—R. A. Smith
*Assistant Examiner*—Tania C Courson
(74) *Attorney, Agent, or Firm*—The Weintraub Group, PLC

(57) ABSTRACT

Variously configured brackets, for displaying a flag and mountable to or integrally formed with a support member such as a helmet, are disclosed. One bracket includes an elongated cantilevered mast and a retention lip, the beam angled upwardly from the bracket and adapted to receive a sleeve formed along one edge of the flag inserted thereover and having a deflectable free end that is forced downwardly into captivated relation with the lip. Other brackets have a chamber and passage arrangement, respectively, for mounting a pole provided along one edge of the flag and passing the flag through the bracket. In one, the pole is parallel with and moved into a chamber at the rearward side of the bracket and the flag passed through a passage. In another, a chamber extends between the opposite lateral sides, the chamber and pole are coaxially aligned, the pole is inserted into the chamber, and the flag passed through the passage.

9 Claims, 4 Drawing Sheets

FIG 1
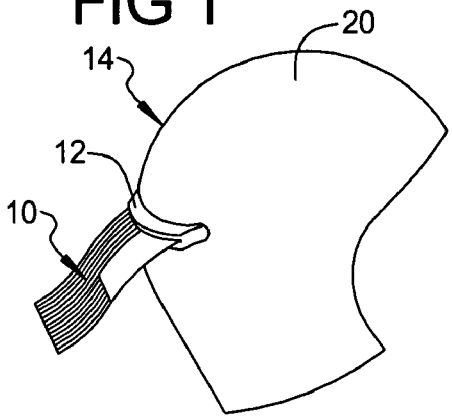
FIG 1A
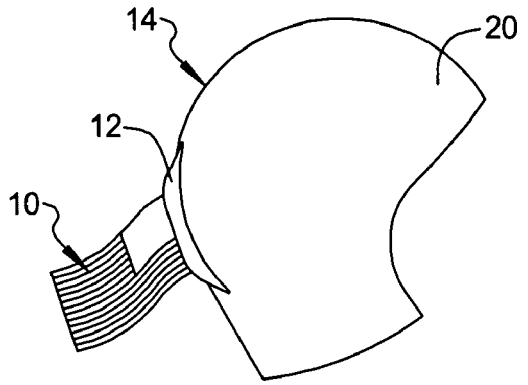
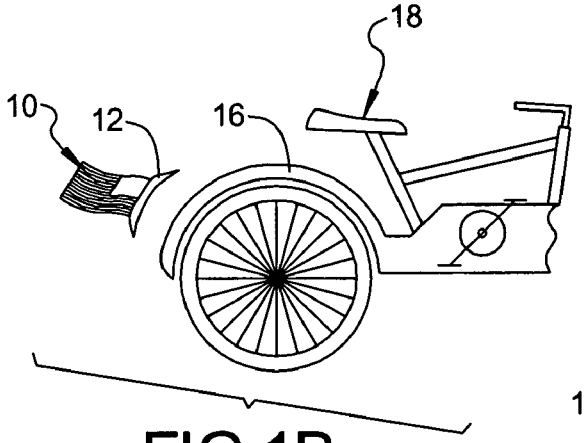
FIG 1B
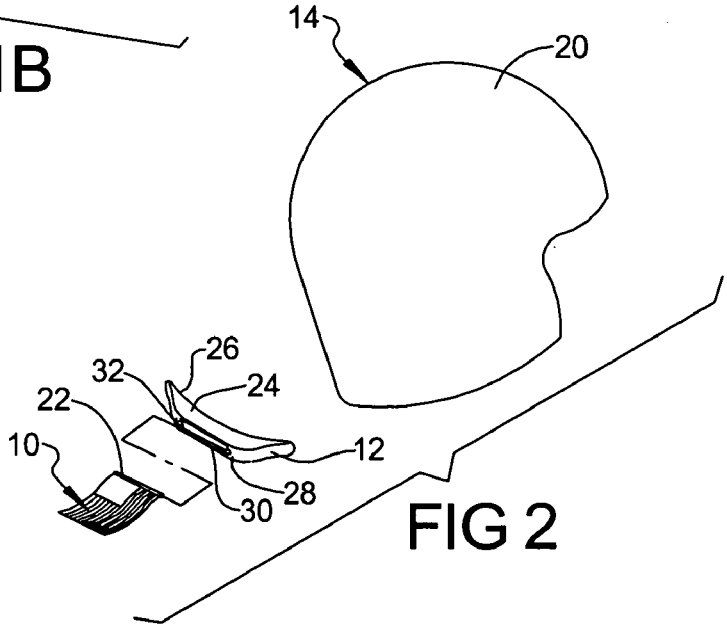
FIG 2

FIG 6
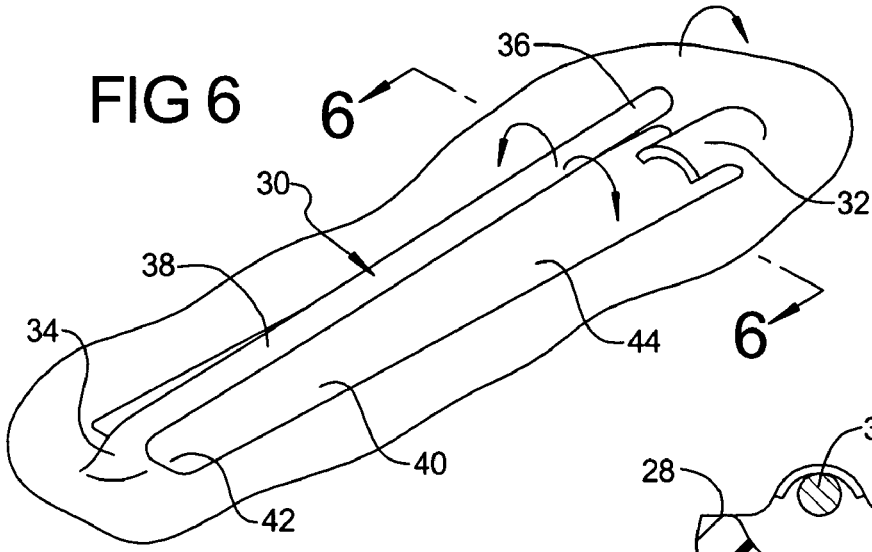
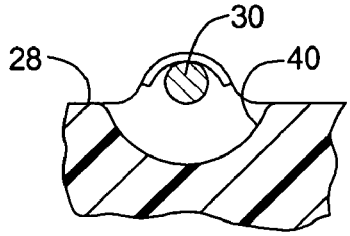
FIG 6A
FIG 7
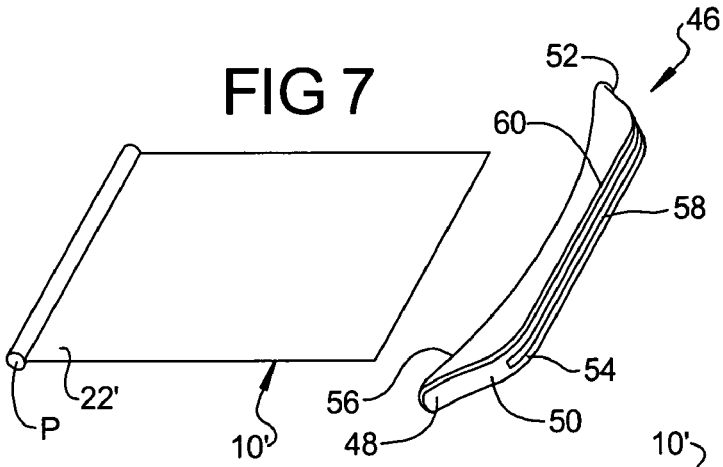
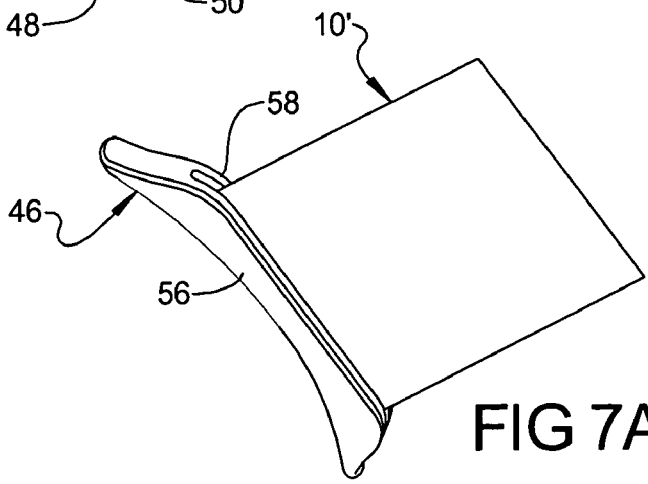
FIG 7A

FIG 8A
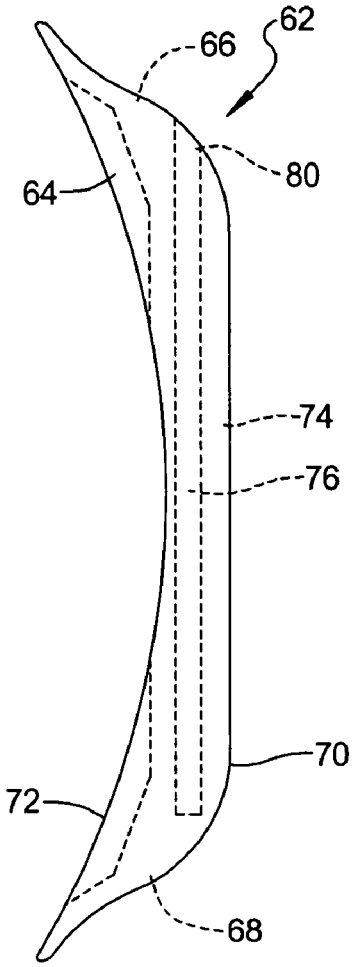
FIG 8B
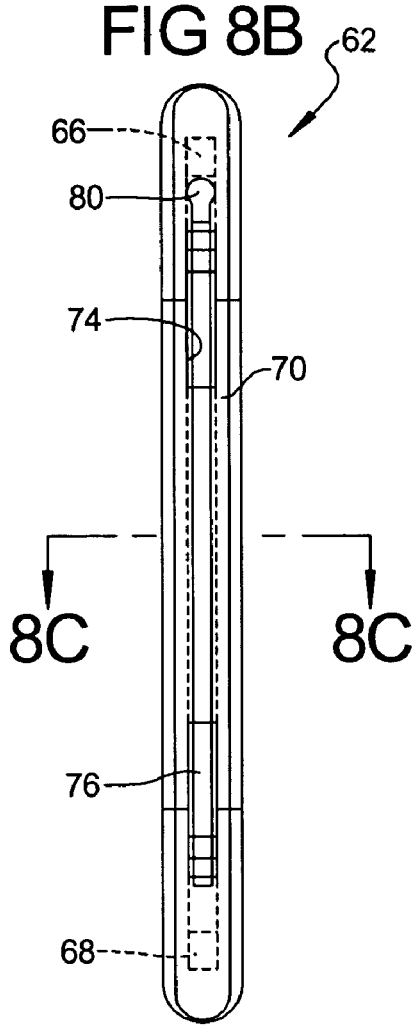
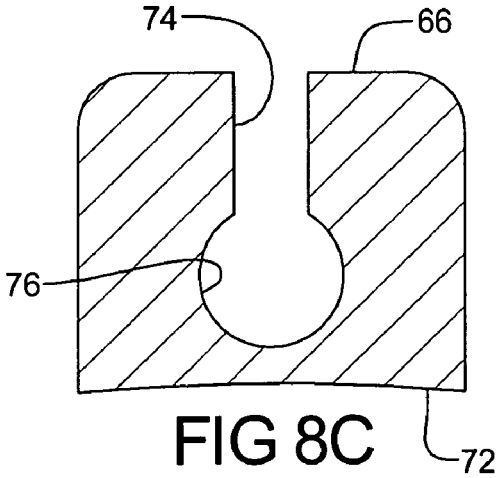
FIG 8C

HELMET BRACKET

CROSS-REFERENCE TO RELATED APPLICATION

This application claims the benefit of co-pending U.S. Provisional Application No. 60/731,314, filed on Oct. 28, 2005, the entire disclosure of which incorporated herein by reference.

BACKGROUND OF THE INVENTION

1. Field of the Invention

The present invention pertains to apparatus for displaying, mounting, or otherwise orienting a flag, banner or like shaped piece of cloth, varying in size, and shape, on a flat or contoured surface, such as a snowmobile, curved fender of a vehicle or motorcycle, bicycle helmet, or any other type of hard protective shell, and more particularly to structure associated with the apparatus for mounting the flag. Even more particularly, the invention pertains to a bracket that has flag mounting structure integrally formed therewith and is adhered to a contoured surface, such as that of a helmet.

2. Description of the Prior Art

In many fields of endeavor, a need exists for flag attachment apparatus, which apparatus enables a flag to be displayed and seen by others. Broadly, the term flag encompasses a piece of cloth, varying in size, shape, color, and design, usually attached at one edge to a staff, or mast, or cord, and used as the symbol of a nation, state, or organization, as a means of signaling. The flag may also be a banner, or pennant and like item. In some applications, a flag is oriented to protrude from a vehicle part, such as a curved fender, and provide a visible warning of danger. In yet other applications, the flag protrudes from a cap or helmet, such as to enable third parties to locate a swimmer or skier, having fallen into the water or a snow bank. Further, the flag may display the symbol of a favored sporting team, be fanciful, be supportive of the national interest, such as by the use of the American flag, or make a political statement, such as during an election.

U.S. Pat. Nos. 3,104,644; 3,106,184; 3,213,823; and 3,217,690 illustrate apparatus for displaying and carrying a flag, such as atop the head of an individual. U.S. Pat. Nos. 2,345,051; 4,905,406; 5,903,925; and 6,616,294 illustrate headgear configured with structure for holding a specific device. Finally, U.S. Pat. Nos. 1,036,168 and 2,167,579 illustrate flagstaff structure.

While each of the above noted patents are believed to have been efficacious in achieving their intended purpose, it is appreciated that there is on ongoing need for improvements.

SUMMARY OF THE INVENTION

Objects and features according to the present invention include provision of a support structure, or bracket, for displaying a flag or like banner.

Another object is provision of a specifically configured bracket wherein a cantilevered flag-bearing pole or mast extends outwardly and away from the bracket, whereupon an indicia cloth, such as a flag or banner, is mounted to or otherwise positioned on the mast, and the mast forced inwardly towards the bracket to be releasably captivated by a retention clip.

Another object is the provision of a resilient support mast that is spring-like in operation, wherein for replacement of a flag or banner on the mast, the mast is disengaged from a retained relation and pop-ups a suitable amount sufficient for a flag or banner to be mounted or removed from the mast.

A further object is the provision of a mast like arrangement, wherein the mast is adapted to be normally stored in abutted relation and captivated against the outwardly facing surface of the support structure, both for safety and aesthetic purposes.

Another important aspect and object of this invention is the provision of a curved support segment, to which the mast and a mast retention are integrally formed, and operate in a safety-pin manner in that the mast is normally biased away from the support segment but abutted thereagainst when retained by the clip.

A further object of this invention is the provision of a separate curved support segment, which is mountable, such as by double-backed adhesive type or like suitable securement means, to a complementary curved surface, such as formed on a helmet or the fender of a vehicle.

Desirably, whether attached to a motorcycle or the fender of a bicycle, such structure would enable customization of wheeled vehicles by users of all ages, both young and old.

A still further object of this invention is the provision of a curved support segment, mountable to a surface of interest, and formed with a cantilever spring-like mast, a retention clip for retaining the deflectable free end of the mast, and a mast receiving channel or recess for receiving and concealing the mast when forced downwardly and stored therein, the channel extending between the base of the mast where joined to the support and the retention clip for captivating the free end of the mast.

Another object is the provision of such flag displaying structure that may be integrally formed with a support member, such as a helmet, or mounted thereto.

Yet another object of this invention is the provision of a support bracket, having a curved inward mounting surface and a flat outward surface, an elongated chamber opening on the inward surface for receiving a pole connected to one edge of the flag, and a rectangular shaped passage extending between the surfaces, the chamber and passage extending between opposite lateral ends of the bracket, the pole seating in the chamber and the flag passing outwardly from the outward surface and away from the support bracket, the curved inward mounting surface being adhered or otherwise secured to a support member, such as a helmet.

Yet another object of this invention is the provision of a support bracket, having a curved inward mounting surface and a forward end portion, a cylindrical passage extending between opposite ends of the support bracket, and a rectangular passage extending between the front face and the cylindrical passage, a pole connected to one edge of the flag being slidably inserted into the cylindrical passage and the flag passing through the rectangular passage and outwardly and away from the support bracket.

Desirably, such provision of each such arrangement would be convenient to use, safe, be attractive, and inexpensive.

Desirably, such structure would enable use by old and young alike.

According to this invention, there is provided a bracket for displaying a flag having a mounting loop along an edge portion thereof, comprising, a body member, the body having opposite lateral ends and a forward end face, an elongated longitudinal mast extending in generally parallel close hugging relation above said forward end face and between said lateral ends, said mast being in the form of a resilient cantilever projecting from said body and having a lower end connected to said body, a free upper end and a medial portion extending between the upper and lower ends, the upper end being normally biased away from but deflectable downwardly and towards said outer surface, said mast being dimensioned to receive and mount the loop of the flag inserted thereabout, and means for releasably retaining the upper end of said mast in the deflected position.

Preferably, the means for releasably retaining the upper end portion of the mast comprises a retention lip, the retention lip being integrally formed with the body. The retention lip may be fingernail shaped and adapted to receive and seat about the upper end portion of the mast when fitted therewithin, the resilience of the mast biasing the upper end portion thereof outwardly and into gripping relation with the retention lip.

In a first aspect of this embodiment, the bracket is formed as a separate element and is adapted to be secured to an object, such as that of a bicycle helmet. The bracket has a contoured mating surface spaced from the forward end face, which mating face is complementary to a complementary contoured surface of the helmet. In this regard, the securement may be by any suitable method used to join complemental parts, including adhesive and the like, including double-backed foam adhesive tape, threaded fasteners, separable fasteners, such as hook and loop-type fasteners and components thereof (e.g., VELCRO®), to name a few.

In a second aspect of this embodiment, the bracket is integrally formed with an object, such as the motorcycle helmet.

In each such arrangement, preferably, the mast and retention lip are integrally formed with the flag-mounting bracket.

In another embodiment of this invention, an elongated groove is provided in the forward end face of the bracket, the groove extending between the opposite lateral ends of the bracket and between the secured end of the mast and the retention lip, the mast superposing the groove and adapted to be nested in the groove when the mast is deflected downwardly and the free end thereof in retained relation with the retaining lip.

Advantageously, according to this embodiment, the groove and mast are dimensioned such that the mast is below the forward end face and substantially hidden from view when the mast is disposed in the groove and retained by the lip.

Desirably, when the mast is deployed and in the flag mounting position, the mast is at an acute angle but substantially close hugging parallel relation with the outer surface of the flag bearing member, yet spaced therefrom by a sufficient distance to permit mounting and replacement of a flag, banner, or the like, and when retained, the relationship of the mast to support member enables the flag to project generally perpendicularly outwardly and away from exterior surface of the mounting member.

Desirably, the flag attachment, retention, and release are convenient.

Additionally, the integral attachment of the pole enables the pole to flex and thereby minimize harm to the user while simultaneously permitting the flag to "flap" when in use.

Further, the integral attachment provides a storing feature, which eliminates the need for costly, and oftentimes, unsightly attachment elements.

Desirably, the attachment enables a flag, banner and the like to be oriented in the horizontal and vertical planes, as desired. Further, the complementary mounting surfaces of the flag-bearing member may have a curved mounting surface to enable firm attachment to the contour of a mounting member, such as a movable carrier (i.e., the curved surface or fender of a car, sled, or bicycle).

In yet another embodiment according to this invention, there is provided, in combination, a mounting member having an exterior surface, a bracket for mounting a flag, said bracket having forward and rearward surfaces, and means for mounting the bracket to the exterior surface of the mounting member with the rearward surface in juxtaposition with the exterior surface, the bracket including (a) an elongated pole having upper and lower ends and a medial portion extending between the ends of the pole for mounting an edge portion of the flag thereto, and (b) a retention lip for retaining the upper end portion of the pole, the lower end portion of the pole and the retention lip being connected to the bracket, wherein the pole forms a resiliently deflectable cantilever that extends in generally parallel relation to the forward surface and is deflectable downwardly towards the forward surface and between an upward position for mounting or removing the flag and a downward position wherein the retention lip releasably captivates and retains the deflectable upper end portion of the pole.

According to this combination, and as discussed above, the elongated pole and retention lip are preferably integrally formed with the bracket, and the exterior surface and the rearward surface are complementary and contoured. Preferably, the mounting member is a helmet such as a bicycle helmet or motorcycle helmet. Preferably, the mounting member is a motorcycle helmet.

Additionally, the bracket may be configured differently, but still mountable to the exterior surface of the mounting member for displaying a flag.

According to this invention, a bracket for displaying a flag member having a flag portion and a pole disposed in a sleeve portion extending along one edge of the flag portion, comprises a body having forward and rearward surfaces and opposite lateral sides, said rearward surface being adapted to be secured to a display member, and a rectangular shaped passageway and an elongated chamber, each said passageway and chamber extending in a first direction between said lateral sides with the passageway extending inwardly from said forward surface and intersecting with said chamber, the chamber being adapted to receive said pole and sleeve portion therein and the passageway being adapted to pass the flag portion outwardly of the chamber and away from the bracket when the pole is in the chamber, the passageway having a dimension less than the cross-sectional dimension of the pole whereby to inhibit the pole from being pulled in a second direction transverse to said first direction, through the passageway, and outwardly of the bracket.

In one preferred arrangement, the chamber may be disposed in the rearward surface of said body and of a dimension to nest the pole and sleeve portion of the flag portion proximate to the rearward surface of the body and said passageway extends rearwardly from the forward surface to open in said chamber.

In another preferred arrangement, the chamber is generally cylindrical and proximate to the forward surface of said body and said passageway extends rearwardly from the forward surface to open in said chamber, the chamber having an inlet that opens on one lateral side of the body and terminating in the body proximate to the other lateral side, the chamber receiving the pole and sleeve portion of the of the flag portion inserted into the chamber in a direction transverse to said first direction.

The present invention will be more clearly understood with reference to the accompanying drawings and to the following Detailed Description, in which like reference numerals refer to like parts and where:

BRIEF DESCRIPTION OF THE DRAWINGS

FIG. 1 is a perspective view of flag mounting bracket, for displaying a flag or banner, and mounted onto a helmet or headpiece, according to the present invention.

FIGS. 1A and 1B are perspective views, similar to FIG. 1, illustrating alternate arrangements, respectively, wherein the flag mounting bracket and associated flag are differently oriented on the headpiece and/or mounted on a curved structure, such as the fender of a vehicle or bicycle, according to this invention FIG. 2 is a perspective view illustrating the arrangement of FIG. 1 wherein a flag and the mounting bracket are positioned for mounting onto the headpiece.

FIG. 6 is a partial perspective view of an alternate embodiment according to this invention wherein a flag-mounting bracket includes a groove for receiving the mast when the mast is in a retained position.

FIG. 6A is a view taken along line A-A of FIG. 6 illustrating the mast and the groove of the flag-mounting bracket.

FIGS. 7 and 7A illustrate an alternate embodiment according to this invention for mounting a flag wherein a pole extends along one edge of the flag, wherein a flag-mounting bracket includes rectangular and cylindrical shaped passages extending between opposite lateral ends of the bracket, the rectangular passage extending between the forward and rearward sides thereof and the cylindrical passage formed on the rearward side of the bracket, the flag being inserted from the rearward side, through the passageway and outwardly from the forward side, and the pole seated in the chamber.

FIGS. 8A and 8B illustrate side and end views of an alternate embodiment according to this invention for mounting a flag wherein a pole extends along one edge of the flag, wherein a flag mounting bracket includes rectangular and cylindrical shaped passages extending between opposite lateral ends of the bracket, the cylindrical passage being proximate to the forward side, and the rectangular passage extending inwardly from the forward side and the cylindrical passage, the pole of the flag being slidably inserted into the cylindrical passage such that the flag extends through the rectangular passage and outwardly from the forward side of the mounting bracket.

FIG. 8C is a view taken along line 8C-8C of FIG. 8B.

DETAILED DESCRIPTION OF THE PREFERRED EMBODIMENT

Figure 3:
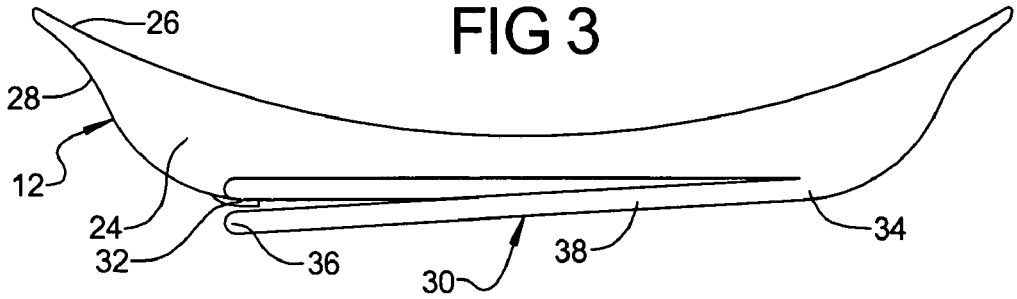
FIGS. 3 and 4 are plan views of the mounting bracket shown in FIG. 2, illustrating a flag mounting mast thereof, respectively, in deployed and retaining positions.

Turning now to the drawings, FIGS. 1-8 illustrate preferred embodiments according to this invention for mounting a flag or like banner to a surface for display. In some of the embodiments, there is disclosed a flag mounting bracket that may be integrally formed with a display member or object, or attached to a receiving support. Other embodiments of flag mounting brackets are intended to be attached to a receiving or support member. In these latter embodiments, the attachment surface of the receiving member may be curved, or at least not flat. Further, the mounting is particularly discussed in connection with the display of a flag or like banner on the curved surface of a helmet.

FIGS. 1, 1A and 1B illustrate an arrangement wherein a flag, banner and the like, generally indicated by the number 10, is mounted to and carried by a flag-mounting bracket, generally indicated by the number 12, and the bracket mounted atop a support or a carrier. The term "carrier" is intended to be construed broadly, such as a helmet or cap or movable vehicle, such as a car, sled, bicycle or the like. As intended herein, the flag-mounting bracket 12 and the carrier may be separately provided, or integrally formed with one another.

In FIGS. 1 and 1A, the flag-mounting bracket 12 is shown being secured onto a cap, head element or helmet worn by a user, generally indicated at 14, with the mounting bracket 12 conforming, at least in part, to the curvature of the cap. The flag 10 is generally rectangular with one edge thereof being adapted to attach to the bracket. When the bracket is mounted to the helmet, the flag 10 may be disposed in the horizontal plane (FIG. 1), the vertical plane (FIG. 1A), or as desired.

In FIG. 1B, the flag-mounting mounting bracket 12 is shown mounted to the contoured rear fender 16 of a bicycle 18 and the flag 10 is disposed in a vertical plane.

As noted herein above, the flag-mounting bracket 12 may be integrally formed with the carrier, or separately provided, and then attached to the carrier, whether the carrier be the helmet or curved surface of the fender. Importantly, in each instance, the flag-mounting bracket 12 enables the flag 10 to be replaced or interchanged, easily, by users of all ages. The bracket may also be configured to permit attachment to a substantially flat surface, if desired.

Although the term flag or banner is used, the term is not intended to be so restricted but rather is intended to apply broadly and cover a wide variety of displayable elements, such political messages, materials used to symbolize a country, state, university, team, organization, or expression.

For the description that follows, and referring to FIGS. 2-5, the mounting bracket 12 is mounted to a head cap or helmet or headpiece 14, and the flag 10 is mounted to the mounting bracket 12, before or after the bracket is attached to the head cap. The helmet or head cap 14 has a curved exterior surface 20 and is adapted to be worn by and conform to the contour of the head of the wearer (not shown), The flag 10 may be generally rectangular, as shown, or of any other desired configuration, so long as it includes an elongated mounting edge, defined in part by an elongated closed loop portion 22. By way of illustration, the flag may be a rectangle of 4 inches by 6 inches, depending on the application The flag-mounting bracket 12 defines a contoured segment or body member 24, the body member having a curved or contoured inner or rearward surface 26, mountable on the exterior surface 20, a generally flat outer or front surface 28, and an elongated longitudinal mast (or pole) 30 and a retention lip 32, disposed on the front surface 28. The mast 30 is in the form of a resilient cantilever beam, projecting from the outer surface 28. The mast 30 includes an inward or lower end portion 34, integrally formed with the bracket segment 24, an outward or upper and portion 36, overlying the outer surface 28, and an elongated portion 38 extending between the inner and outer end portions 34 and 36.

Shown best in FIG. 3, the elongated portion 38 of the mast 30 extends in generally parallel close hugging relation above the front surface 28. When not retained, the mast portion 38 is normally biased away and at a small acute angle to the front surface 28, such that the upper or outward end portion 36 is spaced from the retention lip 32. That is, the mast 30 is angled relative to the front surface 28 by a sufficient amount to permit mounting and replacement of a flag, banner, or the like. The elongated mast portion 38, in use, is dimensioned to receive the loop 22 of the flag 10, slidably inserted thereabout, and position the loop 22 of the flag 10 between the opposite end portions 34 and 36 of the mast 30.

The cantilevered mast 30 is resilient such that the upper end portion 36 thereof is downwardly deflectable towards the outer or front surface 28.

The retention lip 32 releasably retains or captivates the upper end portion 36 of the mast 30, wherein the length 38 of the mast 30 is disposed in a close hugging generally parallel fitment against and along a flat portion of the outer front surface 28, that extends between the ends 34 and 36 of the mast 30. The retention lip 32 is integrally formed with the bracket, fingernail shaped, curved, and adapted to receive and seat about the deflectable upper end portion 36 of the mast 30. The resilience of the mast 30 operates to bias the upper end portion 36 of the mast 30 outwardly and into seated gripping engagement by the curved surface of the lip 32.

Figure 4:
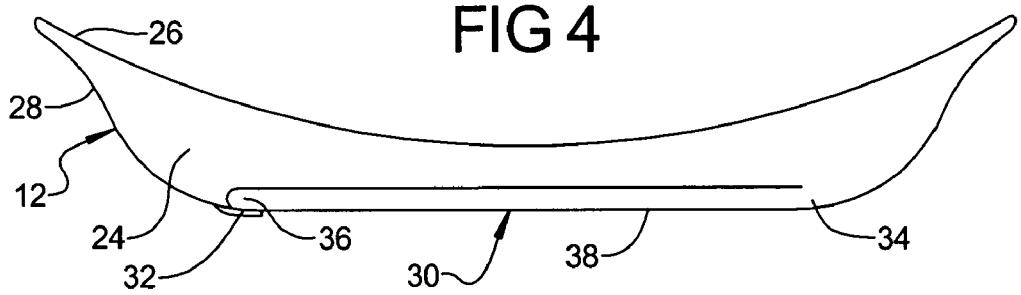

FIG. 4 illustrates the mast 30 retained by the retention lip 32.

In a preferred aspect of this invention, the mounting bracket 12 is formed as a separate element, and has a curved mating surface, such as inner surface 26. Importantly, the curved mating surface 26 is adapted to be secured to a complementary mounting surface 20 of the cap or helmet 14.

In this regard, the securement may be by any suitable method used to join complemental parts, including adhesive and the like, including double-backed foam adhesive tape, threaded fasteners, separable fasteners, such as hook and loop-type fasteners and components thereof (e.g., VELCRO®), to name a few.

In a second preferred aspect of this invention, the contoured segment 24 is integrally formed with the helmet or head cap 14. In such arrangement, the mast 30 and retention lip 32 are integrally formed with the contoured segment or body member 28.

In one method of use, such as shown in FIG. 2, the mast 30 of the flag-mounting bracket 12 is deployed and the free end 36 extends upwardly and away from the body member and retention clip 32. The sleeve 22 is inserted about the mast and the flag 10 is positioned between the opposite ends of the mast. The mast 30 is then forced downwardly and the free end 36 thereof manipulated into retained relation with the lip 32. Thereupon, the mounting bracket 12 is attached to the helmet or head cap 14.

As indicated, the flag 10 may be mounted to the bracket 12 before or after the mounting to the cap 14.

Figure 5:
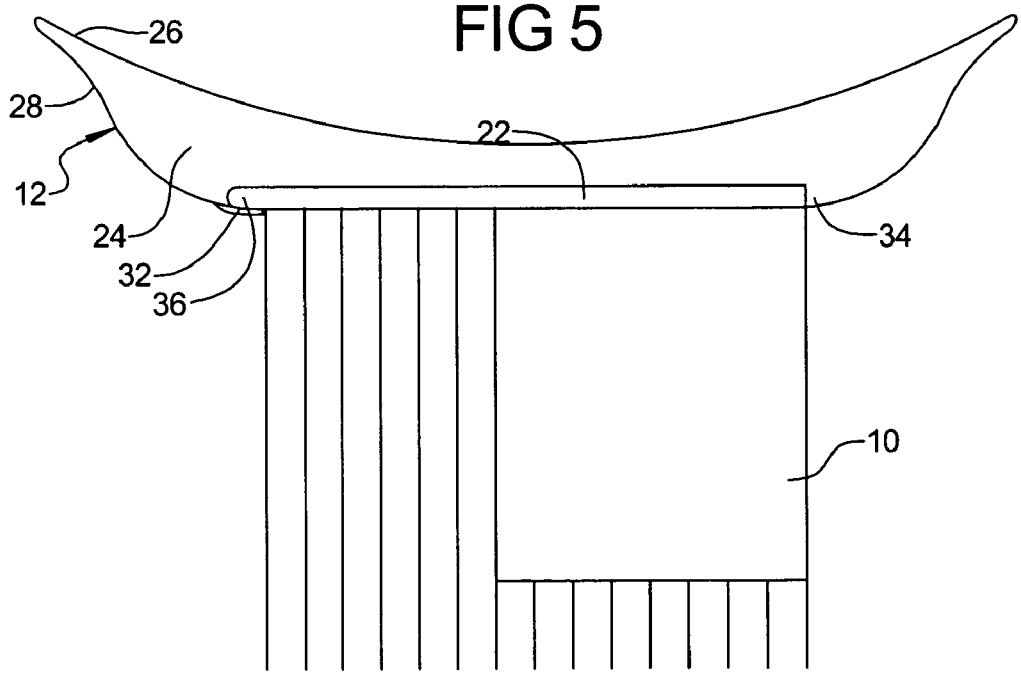
FIG. 5 is a plan view of the mounting bracket of FIGS. 3 and 4 illustrating the mast when retaining a flag to the mounting bracket.

FIG. 5 illustrates the flag 10 mounted on the bracket 12 with the end of the tubular sleeve 22 of the flag 10 positioned on the portion 38 between the opposite end portions 34 and 36 of the mast 30.

Turning to FIGS. 6 and 6A, and according to a preferred embodiment of this invention, an elongated longitudinal groove 40 is provided in the outward facing surface 28 of the contoured segment 24. The groove 40 extends between opposite ends 42 and 44, with each groove end being adjacent to a respective end 34 and 36 of the mast 30. The retaining lip 32 superposes the end 44 of the groove 40.

The groove 40 receives the mast portion 38 and the lip 32 retains the deflectable upper end portion 36 of the mast 30. Desirably, the groove 40 places the flag mounting mast 30 out of sight to provide a more aesthetic appearance. Further, and importantly, the groove 40 cooperates to eliminate any forces that might be place on the mast, and thereby snag on or otherwise pull the mast and flag from the intended position.

As shown in FIG. 6A, the groove 40 is generally shallow and shaped to receive the elongated portion 38 of the mast 30 when the mast is deflected downwardly and into the groove. Generally, the groove 40 has a somewhat a flattened C-shape.

As illustrated in FIG. 6, the arrows indicate that for retention, the mast 30 is first moved laterally followed by substantially simultaneously forcing the free end 36 of the mast downwardly, towards the front surface 28, into the groove 40, and into seated relation with the curved retention lip 32. The two arrows directed laterally of the mast 30 indicate the lateral deflection of the mast. The arrow at the free end 36 of the mast 30 indicates vertical downward deflection of the mast.

FIGS. 7 and 7A illustrate an alternate embodiment according to this invention for mounting a flag 10' wherein a pole "P" is provided along one edge 22' of the flag. According to this embodiment, a flag-mounting bracket 46 includes a body member 48 having opposite lateral sides 50 and 52 and forward and rearward sides 54 and 56. Further, the body member 48 includes a rectangular shaped passageway 58 and a cylindrical shaped passage or chamber 60, each passageway extending between the opposite lateral sides 50 and 52. The rectangular passageway 58 extends between the opposite forward and rearward sides 54 and 56 and the chamber 60 is formed on the rearward side 56 and forms a rearward terminus of the passageway 58.

As described herein above, the rearward side 56 is contoured and adapted to be secured to a contoured receiving surface, such as the curved surface 20 of the helmet 14.

The flag 10' is inserted from the rearward side 56, through the passageway 60, into and though the passageway 58, and outwardly from the forward side 54 and away from the bracket 46. The pole "P" along the edge 22' of the flag 10' is seated in the chamber 60 and is of a dimension greater than that of the passageway 58 to prevent the flag 10' from being pulled outwardly from the forward side 54 of the bracket 46.

FIGS. 8A-8C illustrate an alternate embodiment according to this invention for mounting the flag 10' wherein a pole "P" is provided along one edge 22' of the flag. According to this embodiment, a flag-mounting bracket 62 includes a body member 64 having opposite lateral sides 66 and 68 and forward and rearward sides 70 and 72. Further, the body member 64 includes a rectangular shaped passageway 74 and a cylindrical shaped passage or chamber 76, each passageway extending between the opposite lateral sides 66 and 68. The rectangular passageway 74 extends from the front or forward side 70 and inwardly of the body member to intersect with the cylindrical chamber 76 proximate to the front side 70. The chamber 76 has an opening 80 proximate to the lateral side 66 and terminates, or is closed, proximate to the lateral side 68.

As described herein above, the rearward side 72 is contoured and adapted to be secured to a contoured receiving surface, such as the curved surface 20 of the helmet 14.

The flag 10' positioned by the opening 80 and the pole "P" is slidably inserted from the lateral side 66 inwardly into the chamber 76 and the flag passed through the passageway 74 and outwardly from the forward side 70 and away from the bracket 62. The pole "P" and the chamber 60 are of a dimension greater than that of the passageway 74 to prevent the flag 10' from being pulled outwardly from the bracket 46.

FIG. 8C is a view taken along line 8C-8C of FIG. 8, showing the passageway 74 and the chamber 76.

While the invention has been illustrated and described in detail in the drawings and the foregoing description, the same is to be considered as illustrative and not restrictive in character, it being understood that only the preferred embodiment has been shown and described fully and that all changes and modifications that come within the spirit of the invention are desired to be protected.

Having, thus, described the invention, what is claimed is:

1. A bracket for displaying a flag comprising:

an elongated body member, the body member having opposite lateral ends, the opposite lateral ends being substantially symmetrical to each other, a rearward end face, and a forward end face, the rearward end face being in opposite spaced relation to said forward end face, the rearward end face defining a mating surface that is complementary to and adapted to be secured to a mounting member;

an elongated longitudinal mast extending in generally parallel close hugging relation above said forward end face and between said lateral ends, said mast being in the form of a resilient cantilever projecting from said body and having a proximal end connected to, and integrally formed with, said body, a free distal end and a medial portion extending between the distal and proximal ends, the distal end being biased away from but deflectable towards said outer surface, a flag being removably mounted onto the medial portion of the mast; and a retention lip, the retention lip being integrally formed with the body member and disposed on the body for close interfitment with the distal end of the mast, the retention lip having a lower curved surface which engages and entraps the outwardly biased distal end of the mast, whereby the flag is secured onto the mast.

2. The bracket according to claim 1, further comprising means for securing the rearward surface of said bracket to the mounting member, the means for securing is selected from the group consisting of double-backed foam adhesive tape, threaded fasteners, separable fasteners, and hook and loop-type fasteners.

3. The bracket according to claim 1, wherein said body member is integrally formed with a mounting member.

4. The bracket according to claim 1, further comprising an elongated groove provided in the outward facing forward end face of the body member, the groove extending between the opposite ends of the mast and sized to receive the mast when the mast is retained in the inwardly deflected position by the retention lip, and the retention lip being proximate to the distal free end of the mast and receive and retain the mast when the distal free end is in the inwardly deflected position.

5. The bracket according to claim 2, wherein the groove and distal and medial portions of the mast are disposed between the rearward end face and the forward end face, such that the mast is substantially hidden from view when the mast is disposed in the groove and retained by the lip.

6. In combination, a mounting member having an exterior surface, a bracket for mounting a flag, said bracket having forward and rearward surfaces, and means for mounting the bracket to the exterior surface of the mounting member with the rearward surface in juxtaposition with the exterior surface, the bracket including (a) an elongated pole having upper and lower ends and a medial portion extending between the ends of the pole for mounting an edge portion of the flag thereto, and (b) a retention lip for retaining the upper end portion of the pole, the lower end portion of the pole and the retention lip being connected to the bracket, wherein the pole forms a resiliently deflectable cantilever that extends in generally parallel relation to the forward surface and is deflectable downwardly towards the forward surface and between an upward position for mounting or removing the flag and a downward position wherein the retention lip releasably captivates and retains the deflectable upper end portion of the pole.

7. The invention according to claim 6, wherein the elongated pole and retention lip are integrally formed with the bracket.

8. The invention according to claim 6, wherein the exterior surface and the rearward surface are complementary and contoured.

9. The invention according to claim 8, wherein the mounting member is a motorcycle helmet.

* * * * *